United States Patent [19]

Greer et al.

[11] 4,159,942

[45] Jul. 3, 1979

[54] METHOD AND APPARATUS FOR SEPARATING PARTICLES

[75] Inventors: Raymond T. Greer; Kenneth G. McConnell; Arthur Akers, all of Ames, Iowa

[73] Assignee: Iowa State University Research Foundation, Inc., Ames, Iowa

[21] Appl. No.: 835,502

[22] Filed: Sep. 22, 1977

[51] Int. Cl.[2] ..... B07B 7/08; B07B 11/04

[52] U.S. Cl. ..... 209/143; 209/1; 209/589; 209/933

[58] Field of Search ..... 209/1, 143, 145, 142, 209/133, 74 R, 111.5

[56] References Cited

U.S. PATENT DOCUMENTS

| | | | |
|---|---|---|---|
| 3,472,375 | 10/1969 | Mathews | 209/111.5 X |
| 3,494,217 | 2/1970 | Tanaka et al. | 209/1 X |
| 3,591,000 | 7/1971 | Humphreys | 209/210 |
| 3,731,464 | 5/1973 | Brumbaugh et al. | 209/143 X |
| 3,901,798 | 8/1975 | Peterson | 209/143 |

FOREIGN PATENT DOCUMENTS

| | | | |
|---|---|---|---|
| 2456140 | 6/1976 | Fed. Rep. of Germany | 209/142 |
| 245654 | 8/1947 | Switzerland | 209/143 |

*Primary Examiner*—Ralph J. Hill

*Attorney, Agent, or Firm*—Zarley, McKee, Thomte, Voorhees & Sease

[57] ABSTRACT

The method for separating particles having mixed density and/or size, comprises dispersing the particles in a fluid stream, passing the fluid stream into a housing which causes the fluid stream to be diverted from its original direction, and capturing certain of the particles within the housing which deflect the least amount in response to the directional diversion of the fluid stream. Apparatus for accomplishing this method include a channel in which the air flow undergoes a change in direction of 90°, one boundary being a right angle bend and the other being formed from a circular curve or rectangular hyperbola. Another device for accomplishing the method includes an inlet channel which enlarges in diameter and which includes capturing means placed along the longitudinal axis of the inlet channel, whereby the fluid must divert radially outwardly around the capturing means as it passes from the inlet channel through the enlarged portion thereof. A further modification of the device includes a channel having an elbow bend at an acute angle with respect to the longitudinal axis of the channel so that the fluid is diverted at an angle greater than 90°. A further modification to the device includes means for moving the capturing device in response to fluid velocity change and/or chemical composition of the particles.

17 Claims, 8 Drawing Figures

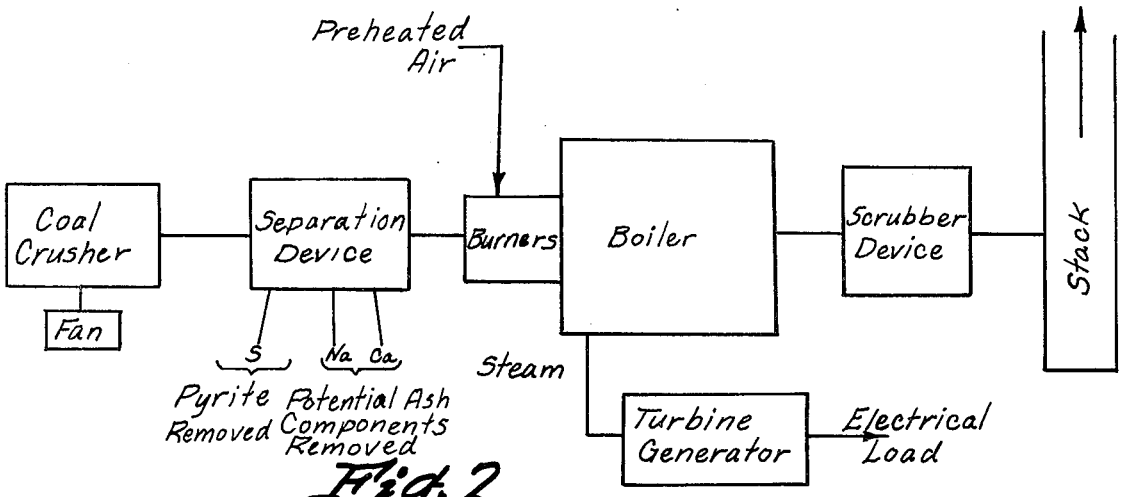
Fig. 2
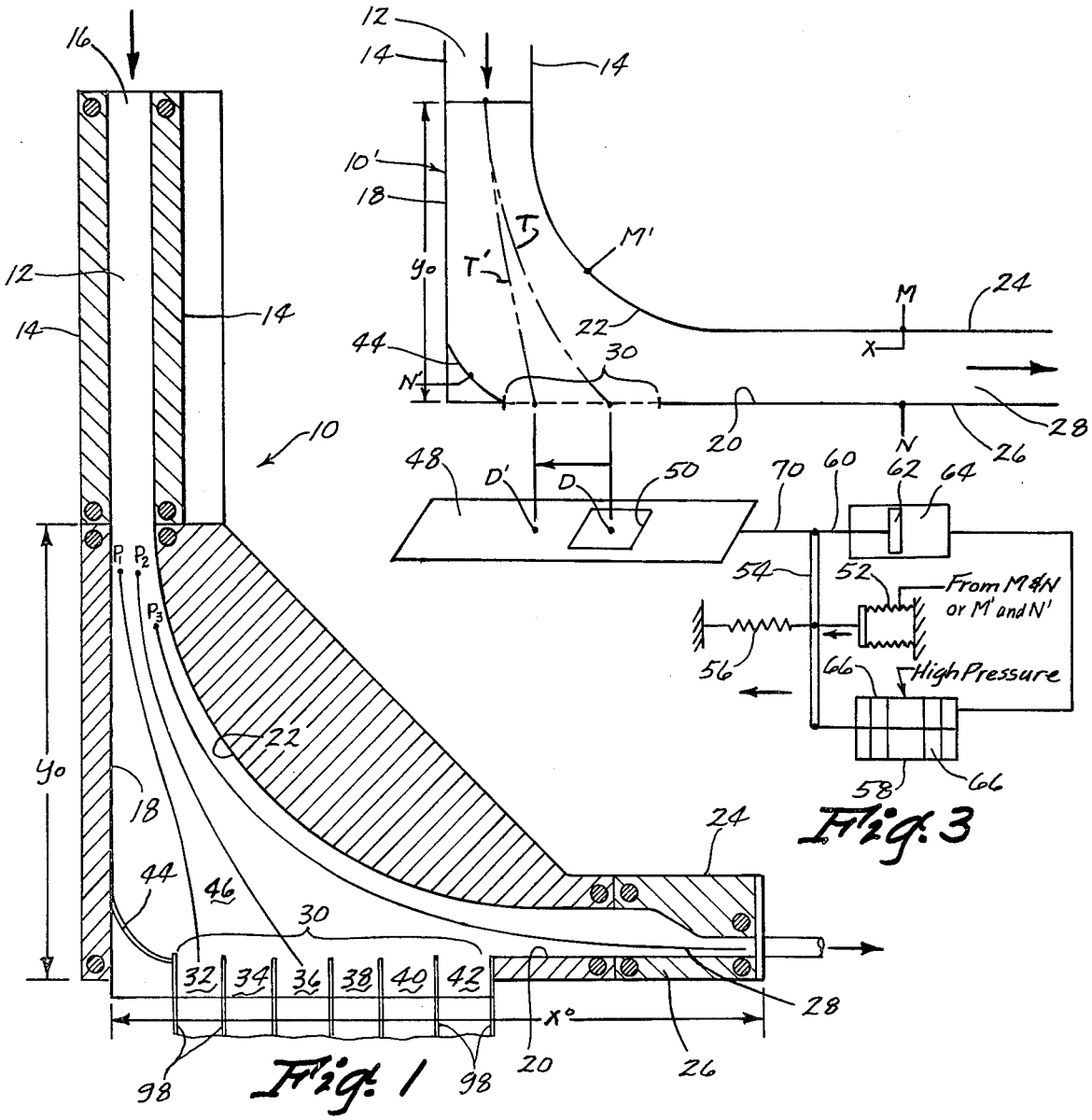
Fig. 3
Fig. 1

METHOD AND APPARATUS FOR SEPARATING PARTICLES

BACKGROUND OF THE INVENTION

This invention relates generally to a method and apparatus for separating particles. Specifically the present invention contemplates separating the particles by density and/or by size.

A need presently exists for economically and easily removing sulfur from coal prior to combustion. Sulfur in coal is found in three common forms: Pyrite ($FeS_2$), sulfate sulfur (e.g., gypsum, $CaSO_4.2H_2O$), and organic sulfur. Of these, pyrite tends to be the principal source of sulfur in coal with organic sulfur and sulfate sulfur being present usually only in minor amounts. While organic sulfur content is usually low, it may in some instances be substantial. For example, in Iowa and Illinois coal the ratio of inorganic pyrite sulfur to organic sulfur is 3:2.

In addition, it is also desirable to remove certain other impurities from the coal which produce ash in the burning process. The most prominent of these include calcite ($CaCO_3$); silica ($SiO_2$); and certain clays including those containing sodium.

These ash impurities and the sulfur hinder the combustion process in numerous ways. They contribute significantly to the pollution in the smokestack emissions, thereby creating the need for expensive and energy consuming equipment to reduce the pollution from smokestack emissions. They also cause slag formation in the boiler, and they reduce the temperature of combustion in the boiler. By removing these from the coal, it would be possible to increase the efficiency of the burning in the boiler and also raise the temperature. Furthermore, the pollution from the smokestack would be significantly reduced, and the need for anti-pollution devices would also be reduced.

SUMMARY OF THE INVENTION

The present invention contemplates the introduction of a moving fluid stream containing the particles to be separated into a housing having two opposite boundaries extending between an inlet and an outlet. One of these boundaries includes a right angle surface and the other of the boundaries includes a curved surface which may be either circular or hyperbolic in configuration. As the fluid enters the chamber, it is diverted 90° direction and then exits outwardly through the outlet opening in the housing. The particles within the fluid stream deflect from their original direction of movement in varying trajectories, each trajectory being determined by the relative size and/or density of the particular particle. Those particles of greater density and/or greater size tend to deflect from their original direction of movement the least amount, and those lighter or smaller particles tend to deflect a greater amount. A separation parameter B may be represented by the following formula:

$$B=(18\mu y_o/\rho_p V_o d^2)$$

where $\mu$ is the absolute viscosity of air (at 60° F., $3.74=10^{-7}$ in slug/ft. sec.)

$y_o$ is the distance $y_o$ indicated in FIG. 1 (in feet).

$V_o$ is the air velocity (in feet/sec.)

$\rho_p$ is the particle density (in slug/cu. ft.) and d is the particle diameter (assuming that the particle is approximately spherical in shape) (in feet).

As the value of B decreases, deflection from the original direction of movement is less. As B increases, the deflection is greater. From the above formula, it can be seen that for any given separator device utilizing an air stream, the numerator of the above formula becomes a constant and the three variables which affect the value of B are particle density, the diameter of the particle and the velocity of the air stream. As the value of B increases for a given particle, the trajectory of that particle tends to more closely follow the air stream. As the value of B decreases, the particle tends to continue on in a trajectory more closely approximating its original line of movement.

If the velocity of the air flow is held constant, and if the diameters of the particles are made to be approximately the same, the device will separate the particles on the basis of density, those particles having the greater density tending to deflect the least amount, and those particles having the least density, tending to deflect the greatest amount. Similarly, if the particles are of homogeneous chemical composition and thereby of the same density, it is possible to separate on the basis of particle size by maintaining the velocity constant, the larger sized particles tending to deflect the least amount, and the smaller sized particles tending to deflect the greater amount.

With respect to coal dust, the pyrite particles have the greatest density, then the calcite, then the silica, then the clays, and finally the coal particles. Accordingly, when coal dust particles of approximately the same size are passed through the device of the present invention, the pyrites tend to collect adjacent the corner of the right angle boundary with the calcites, silica and clays collecting at increasingly further distances from this corner, and with the coal dust passing outwardly through the outlet opening in the housing.

The geometry of the device may be varied in numerous fashions to produce the same result. For example, an axially symmetrical geometry is shown in FIG. 6 wherein the device includes an inlet conduit which enlarges in diameter so that the air stream passing into the enlarged diameter portion will expand radially outwardly. The particles of heavier density will tend not to expand and will be captured by a collecting means which is centrally located in the enlarged diameter portion.

FIG. 8 illustrates a further modification whereby the fluid stream passes through an elbow bend extending at angles which may vary between 20° and nearly 180° with respect to the directional movement of the air stream. The lighter particles will tend to complete the angular turn around the elbow bend, whereas the heavier particles will tend to continue on in their original direction where they are collected at the end of the conduit.

In a conventional steam generating system, utilizing the separator of the present invention, the demand from the burner varies, and this results in changes in the velocity of the air stream which pneumatically feeds the coal to the burner. If the separation device is placed in this pneumatic stream, the velocity of the air stream passing through the separation device will vary according to the needs of the burner. As can be seen from the aforementioned formula for the separation parameter B, changes in velocity cause particles of similar density to deflect in different trajectories than they would follow if the velocity remained constant. Accordingly, it is necessary to sense the velocity of the air passing through the separation device, and move the collection apparatus to various positions in response to these velocity changes. By so doing, it is possible to keep the collection apparatus in registered alignment with the trajectories of certain pre-selected particles of a given density and size even though the velocity of the air stream may vary. The present invention contemplates sensing means for sensing the velocity of the air passing through the separator and for moving the collecting device in response to such variation in velocity.

Similarly, the present invention includes apparatus for sensing the particular composition of the coal dust passing through the separation device. For example, some coal may be high in pyrite but low in sodium impurities, and therefore it may be desirable to position the capturing means so that it will capture only the pyrite particles.

The composition of the particles in the air stream may be analyzed by bombarding the particles with X-rays, gamma rays or other high voltage electron beams. Such bombardment has been found to produce secondary X-ray emission from each of the particles and the secondary X-ray emission from each particle is unique to the particular chemical composition of the particle. Detector means are placed within the separation device for sensing these various unique characteristic X-rays emanating from the various particles in the air stream. The detector senses these characteristic X-rays and conveys them to an analyzer circuit which in turn operates control means for moving the collector device to certain pre-selected positions corresponding to the trajectories of the various compositions of the particles within the air stream.

By so doing, it is possible to move the collector means to the area where the greatest number of impurities will fall, thereby maximizing the efficiency with which the separator separates the impurities from the coal. For example, if the particular composition of particles is high in pyrite and low in sodium, the collector means will be moved to the position for collecting pyrites, and will be moved away from the area where the sodium particles would normally collect. Similarly, if the composition is high in sodium components, the collectors can be moved into the path of the trajectory of the sodium particles.

While the present invention may be used for the separation of impurities from coal dust, the same method and apparatus can be utilized to separate other types of particles either by density or size. Examples of materials for such a separating treatment include sugar, ceramic or metallic particles for sintering, pollen grain separation, shredding or recycling process constituents, and practically any fine particulate material which is submicrometer to tens and hundreds of micrometers in diameter. Therefore, a primary object of the present invention is the provision of an improved means and method for separating particles by density and/or size.

A further object of the present invention is the separating of impurities from coal so as to eliminate or at least partially eliminate the need for anti-pollution equipment to take the unburned impurities out of the smokestack emissions.

A further object of the present invention is the reduction of undesirable products of combustion from coal prior to burning of the coal.

A further object of the present invention is the reduction of slag formation in the boiler of a coal burning device.

A further object of the present invention is the elimination of impurities from coal so as to produce the capability of higher temperature of combustion when the coal is burned.

A further object of the present invention is the provision of a method and means for separating coal particles so as to meet environmental standards at less expense and with a minimum expenditure of energy.

A further object of the present invention is the provision of a method and means for separating particles which permit adjustment in response to varying velocity of the air stream within the separating device.

A further object of the present invention is the provision of a separation device which is adjustable in response to variations in percentages of the chemical composition of the particles passing therethrough.

A further object of the present invention is the provision of a method and means which are economical, durable in use and practical in application.

BRIEF DESCRIPTION OF THE DRAWINGS

FIG. 1 is a sectional view of apparatus for separating the particles according to the present invention.

FIG. 2 is a block diagram illustrating the use of the present invention in combination with a coal fueled steam generation system.

FIG. 3 is a schematic view of a second modification of the device shown in FIG. 1 wherein means are provided for moving the position of the collector in response to varying velocities of air within the separator.

DETAILED DESCRIPTION OF THE DRAWINGS

Figures 4, 5, 6, 7, 8:
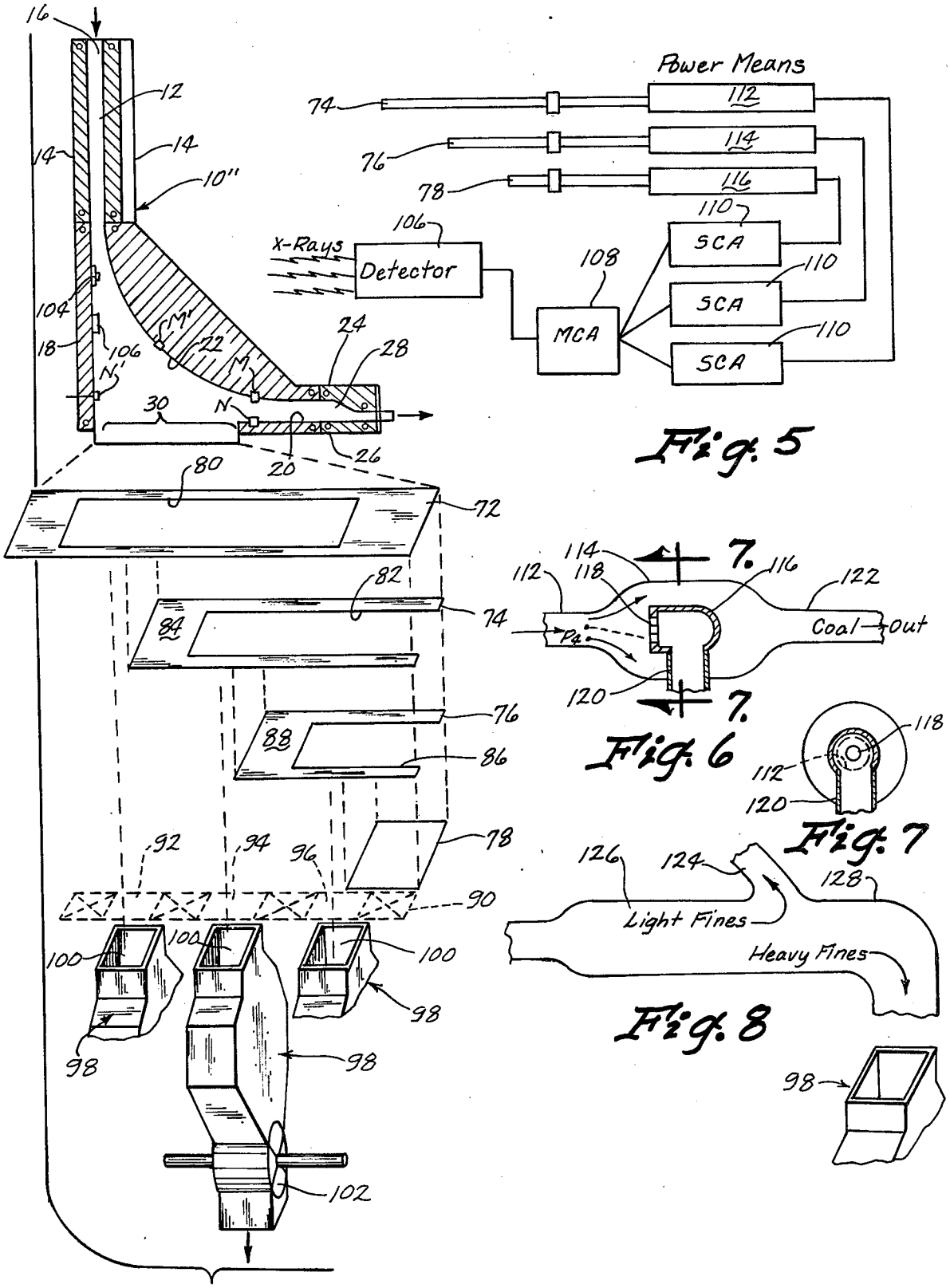
FIG. 4 is a schematic view of a further modification wherein means are provided for moving the collector in response to both variations in air velocity and variations in chemical composition of the particles.
FIG. 5 is a schematic view of the control means for use with the device in FIG. 4.
FIG. 6 is a sectional view showing the further modification of the present separating device wherein the geometric arrangement is axially symmetric.
FIG. 7 is a sectional view taken along line 7—7 of FIG. 6.
FIG. 8 is a sectional view of a further modification of the apparatus for separating the particles.

Referring to FIG. 1, the simplest form of the separator device is designated generally by the numeral 10. Device 10 is comprised of a pair of parallel spaced apart base plates 12 (only one of which is shown in FIG. 1 as a result of the sectional view), a pair of parallel side rails 14 which together form an elongated inlet passageway 16, a first straight boundary wall 18, a second straight boundary wall 20 perpendicular to wall 18, a curved boundary wall 22, and a pair of spaced apart side rails 24, 26 forming an outlet passageway 28. A capturing opening 30 is provided between the lower end of a first straight boundary wall 18 and outlet passageway 28 and is subdivided into a plurality of collection receptacles 32–42. The number of collection receptacles may be varied according to choice. In the lower lefthand corner, adjacent the lowermost end of first boundary wall 18, is a curved surface 44 which is adapted to eliminate a stagnation corner immediately adjacent the lower end of first boundary wall 18.

The space within device 10 between inlet passageway 12 and outlet passageway 28 will be referred to for purposes of reference as a separating chamber 46. It will be noted that separation chamber 46 includes a right angle boundary formed by first boundary wall 18 and by second boundary wall 20 and capturing opening 30. Opposite this right angle boundary surface is the curved boundary wall 22. For purposes of reference, boundary wall 18 defines an axis $y_o$ and boundary wall 20 defines an axis $x_o$.

In operation, particles are introduced into inlet passageway 16 by means of a moving air stream with the particles being dispersed in the air stream. The mixture of particles in the air stream may be of a homogeneous composition (as, for example, sugar), with the various particles having a different size. In this particular case, the particles will tend to be separated by diameter, the particles having a greater diameter falling into the receptacles 32–42, and the particles having a smaller diameter passing outwardly through outlet passageway 28. For example, in FIG. 2, three particles $P_1$, $P_2$, $P_3$ are shown, each of which has a different trajectory. The particles having the greatest diameter would tend to follow the trajectory shown for $P_1$, whereas, the particles of intermediate diameter would tend to follow the trajectory followed by $P_2$, and the particles of the least diameter would tend to pass on outwardly through passageway 28 as indicated by the trajectory of $P_3$.

Another use for the device occurs when the particles introduced are not of homogeneous composition, but instead include particles of varying particle types. A typical example of such an application would be in the separation of coal dust which includes pyrites as well as other ash materials mixed with the coal dust. For this type of separation, it is preferable to grind the coal dust and other particles to a reasonably uniform particle size so that the particles will be separated on the basis of density rather than size. In such a case, the heavier particles (the pyrites), would tend to accumulate in the left most receptacles, whereas the lighter particles (the ash particles) would tend to accumulate in the right hand receptacles. The coal particles would tend to pass through the device and outwardly through the outlet passageway.

Because as a practical matter the particles cannot be ground to exactly uniform size, a certain amount of separation will take place as the result of particle size as well as by virtue of particle density, but experimentation has shown that the pyrites and other ash materials tend to be accumulated in the receptacles 32–42 so as to separate a high percentage of them from the coal dust.

There are several factors which affect the behavior of the particles within the separator device. The following formula for B can be used to predict the manner in which the particles will behave:

$$B=(18\mu y_o/\rho_p V_o d^2)$$

For the particular geometric shape shown in FIG. 1, it has been found experimentally that if the various parameters are chosen so that B is approximately equal to or greater than 4, the particles will pass completely through the separator without being captured by receptacles 32–42. However, if the value of B is less than 4, the particles will be captured in receptacles 32–42. As the value of B decreases, the particles will be captured in receptacles closer to boundary wall 18.

As long as the geometric shape of the device stays as shown in FIG. 1, the value of 3.5 to 4.1 for B is critical in determining whether or not the particle will exit from the separator device. This is true even if the dimensions of the device are changes so long as the proportions and relative shapes shown in FIG. 1 remain the same. However, if the geometric shape is changed in some manner, as for example changing curved surface 22 from a circular curved surface to a hyperbolic curved surface, the critical value of B will have to be redetermined experimentally.

In most practical applications for the separator device of the present invention, most of the various factors set forth in the above equation can be controlled so as to remain essentially constant. For example, the value of $\mu$ is a constant pertaining to the absolute viscosity of the fluid used in the separation device. In most applications this fluid will be air, and therefore the value of $\mu$ will be constant dependent on air temperature. However, it should be recognized that if for some reason a different fluid is used, the value of $\mu$ changes, thereby affecting the value of B.

Another factor which for any specific separation device will be constant, is the value of $y_o$. This is the distance of the entry point of the particles above the collection receptacles 32 and the outlet passageway 28 shown in FIG. 1. For any given device, this distance will be constant, but if the dimensions of the device are changed, the value of B will also be changed unless some other variable is also adjusted to compensate for the change in $y_o$.

Another factor which is important to the present invention is the orientation of the separation device with respect to gravitational force. The preferred arrangement for the separator device is placement of the device in a horizontal plane so that both the y axis ($y_o$) in FIG. 1 and the x axis ($x_o$) in FIG. 1, lie in a horizontal plane which is perpendicular to the gravitational force. In this arrangment, gravity has a negligible effect upon the performance of the separator device. Other orientations of the x,y axis with respect to gravity result in gravity affecting the trajectories of the particles in such a manner that their separation is either hindered or prevented altogether.

The velocity of the fluid also affects the value of B. As the velocity increases, the value of B decreases, thereby resulting in less deflection of the lighter particles than would be the case with a slower velocity. If the velocity is controlled and held constant, separation on the basis of either particle size or particle density can be accomplished. The choice of velocity will be affected by the value of $y_o$. Thus, as $y_o$ is increased, the velocity must be increased accordingly. The proper choice for $y_o$ and $v_o$ will be determined by the particle size and density of the particular particles being separated. The choice will be made in such a manner that the value of B will be greater than 4 for the particular particles which are to exit through outlet passageway 28 and less than 4 for the particular particles which are to be captured.

The particle size also affects the value of B. As the size of the particle increases, the value of B decreases, thereby causing the trajectory to be closer to the y axis. In the use of coal for generating steam, the coal is traditionally screened in most applications to a size less than 200 mesh (76 micrometers). Thus, a relatively homogeneous particle size is obtained in the coal application. In such a situation, the primary variable left is the density of the particles, and the separation can be effected on the basis of density.

Conversely, if it is desired to separate the particles on the basis of size rather than density, all of the variables are held constant with the exception of the particle size. Thus, a homogeneous mixture of particles is used rather than a mixture of particles of different densities. An example of such an application would be the separation of sugar on the basis of particle size.

Below are two examples illustrating the use of the device shown in FIG. 1 to separate coal dust (Example 1) on the basis of particle density, and sugar (Example 2) on the basis of particle size.

EXAMPLE 1

Coal having pyrites and other ash producing impurities therein was separated by a device having the shape configuration shown in FIG. 1. The value of $y_o$ was 2.5 feet. Air was used as the fluid medium (absolute velocity of $3.74\times10^{-7}$ slug/ft. sec.) The particles were screened so as to include particles ranging in size from approximately 70 micrometers to 200 micrometers. These particles were not necessarily spherical in shape, but while theoretically changes in the shapes of the particles should affect their behavior in these tests, empirical data has shown that these particles tend to behave in approximately the same manner as if they were spherical in shape. Thus, changes in the shapes of the particles appear to have a negligible effect upon the manner in which they are separated by the present invention.

The velocity of the air stream was approximately 34 feet per second. The sulfur content of the coal dust dispersed in the air stream was approximately 5% by weight. The pyrite tended to collect in the collection bins, and the material passing completely through the separator was found to have a pyrite concentration of approximately 2.9% by weight. The recovery of material passing through the separator was approximately 93.3% of that entering the inlet opening. It was found that by eliminating some of the right hand bins, the amount of pyrite removed was somewhat less, but the total material recovery was somewhat greater. For example, when all the bins but the leftmost bins were covered, the material exiting from the outlet opening was approximately 99.6% of the material entering the inlet opening, and was reduced in pyrite concentration to approximately 4.1% by weight.

EXAMPLE 2

A weighed sample of sugar having a maximum dimension of between 2.5 to 20 mils (1/1000 inches) was introduced into the same device described in Example 1 above. The air velocity was the same also. It was found that the sugar particles were separated by particle size in the various collection bins, with those bins closest to the y axis containing the larger sized particles and with those bins furthest from the y axis containing smaller particles. The smallest particles exited from the outlet opening. The average particle size exiting from the outlet opening was 5.28 mils and the average size of particles collected was approximately 7.81 mils.

Referring to FIG. 2, a typical steam generation system is shown in block diagram with the separation device of the present invention incorporated therein. The system for generating steam includes a coal crusher for crushing the coal to the desired particle size. A fan forces the coal dust pneumatically to the burners where the coal is combusted to heat water within the boiler creating steam for driving the turbine generator. After combustion, the emissions from the burner are passed through a scrubber device for removing pollutants and then are permitted to exit through a smoke stack. Scrubber devices are very expensive, and consume much energy in removing the pollutants from the stack emissions.

The present invention is inserted in the pneumatic conduit between the coal crusher and the burner and depends upon the pneumatic air stream from the fan for supplying the air stream through the separation device. The velocity of the air passing through the separation device varies depending upon the demand from the burner for coal. Thus, the variance of the air stream velocity within the separator device creates the need for means for sensing the velocity and moving the collector apparatus in response to velocity changes.

FIG. 3 illustrates schematically one form of a device which may be used to adjust the position of the collector in response to varying velocities within the separating device. Device 10' in FIG. 3 is identical in construction to device 10 of FIG. 1 with the exception that collection receptacles 32–42 are replaced by a sliding collection plate 48 having an opening 50 therein. Plate 48 is mounted for sliding movement in a horizontal direction toward and away from first boundary wall 18. Lateral movement of plate 48 causes opening 50 to be moved toward and away from the y axis of the separator device.

Various sensing devices may be placed within the chamber formed by separator 10' for sensing the velocity of the air stream passing therethrough. For example, a pressure sensing device may be placed at points M, N for sensing the differentials in pressure at the two points M and N shown in FIG. 3. These pressure sensing devices may be of the Bernoulli type including pitot, venturi, or orifice devices. One example of a pitot static tube device is Model PDA-12-F-10-KL manufactured by United Sensor and Control Corp., 85 School St., Watertown, Mass. 02172.

Another type of sensing device may be placed at points M', N' and in this case the device would detect a pressure differential at points M' and N' caused by centrifugal action. An example of this type of detector is Model 570B-100T-1A1-VI Manufactured by Data Metrics, a subsidiary of ITE imperial, Wilmington, Mass. Other pressure or velocity sensing devices may be used, the primary purpose being to sense the velocity of the air stream moving through the separating device 10'. The velocity sensing devices at points M and N, or M' and N', are connected to a bellows 52 which is adapted to expand and retract in response to changes in pressure. Bellows 52 is mechanically connected to a vertical arm 54, and arm 54 is spring biased to the right as viewed in FIG. 3 by means of a spring 56. Arm 54 is connected at its lower end to a servo valve 58 and is connected at its upper end to a piston rod 60 of a hydraulic piston 62 and cylinder 64. Servo valve 58 is hydraulically connected to cylinder 64 so that longitudinal movement of the spools 66 within servo valve 58 causes corresponding longitudinal movement of piston 62.

Thus, the connection of piston rod 60 to arm 54 tracks the connection point of spool 66 to the lower end of arm 54. A mechanical link 70 interconnects the upper end of arm 54 and collection plate 48 so that the movement of piston 62 causes corresponding movement of plate 48.

In operation, whenever the velocity changes within separation device 10', the sensing devices M, N or M', N' detect this velocity change and cause a corresponding movement of bellows 52. Increases the velocity of the air cause bellows 52 to move to the left as viewed in FIG. 3 and decreases in velocity cause the bellows to move to the right. Movement of bellows 52 to the left as viewed in FIG. 3 will cause arm 54 to pivot in a clockwise direction about its pivotal connection to piston rod 60. This is because piston 62 is held rigidly by the hydraulic pressures on opposite sides thereof. The clockwise movement of arm 54 causes spool 66 within servo valve 58 to be moved to the left, thereby causing a pressure differential on opposite sides of piston 62 which will result in movement of piston 62 to the left until arm 54 assumes a vertical position. This movement of piston 62 to the left causes plate 48 to also move to the left, thereby repositioning the center of opening 50 from its original position designated by the letter D to its second position designated by the letter D'. The distance which aperture 50 is moved to the left is made to correspond to the change in trajectory of the particles desired to be captured. The letter T designates the original trajectory of such particles and the letter T' designates the trajectory of the same particles after the velocity has increased. Thus, the device shown in FIG. 3 is capable of maintaining aperture 50 in registered alignment with the trajectory of the particles desired to be captured in response to variations of velocity within the separating device.

The use of hydraulic cylinder 64 and servo valve 58 in the combination shown in FIG. 3, is only one of many which may be used to move plate 48 in response to various velocity changes within the separator device. Solenoids could also be used, as could other types of prime movers which are controlled by velocity change within the separating device.

FIG. 4 illustrates a further modification of the present invention whereby the receptacles may be moved not only in response to velocity changes within the device, but also in response to various proportional changes in the amounts of pyrites or other ash components within the coal dust. For example, coal dust from one particular geographical region may be very high in pyrite and low in other ash components, whereas coal from another geographical region may be very high in ash components and low in pyrite. By moving the receptacle openings in response to these proportional changes, it is possible to minimize the amount of coal dust which is lost as the result of being collected in the collector bins, and also to maximize the amount of impurities which are collected. Separator device 10" is identical in construction with the devices shown in FIGS. 1 and 3 with the exception that four collector plates, 72, 74, 76 and 78 are used instead of the one collector plate 48 shown in FIG. 3. Collector plate 72 includes an elongated opening 80 which is large enough to cover the trajectories of pyrite, sodium ash particles, and calcite ash particles. Plate 74 inclues a U-shaped opening 82 and a cover plate portion 84 at one end thereof. Plate 76 is slightly smaller and includes a similar U-shaped opening 86 having a plate portion 88 at the inner end thereof. Plate 78 is a solid plate. The size of U-shaped opening 82 is slightly larger than the size of U-shaped opening 86.

In the relative positions of plates 72–78 as shown in FIG. 4, the plate portions 84 and 88 block out part of the original opening 80 to create the pattern designated by the numeral 90. In this pattern, three openings are formed, a first opening 92, which is positioned to receive the particles of pyrite, a second opening 94 which is positioned to receive the sodium ash producing particles, and a third opening 96 which is positioned to receive the calcite ash producing particles.

One or more lock extractors 98 may be positioned below plates 72, 74, 76 to receive the particles which fall through the openings therein. Extractors 98 include an open upper end 100 for receiving the particles, and a rotating paddle wheel 102 adapted to permit the particles to continue downward from extractors 98, while at the same time closing off extractors 98 so as to avoid affecting the air pressure within separator 10".

Within separating device 10" are velocity sensing devices M, N or M', N' which are identical to that shown in FIG. 3. These velocity sensing devices are connected to control means such as shown in FIG. 3, which in turn are adapted to move plates 72–78 in unison, either to the right or to the left in response to varying velocities of the air within the device. Therefore, the plates 72–78 are moved in unison to position them correctly in response to air velocity variations.

Also within device 10 is an emitting device 104 which is adapted to emit a 30 to 50 kilo volt electron beam into the chamber. Various types of emissions may be used including X-rays or gamma rays. It has previously been known that particles, when bombarded by these X-rays, gamma rays or electron beams, produce a secondary X-ray radiation which has characteristics unique to the chemical composition of each particular particle. Thus, by bombarding the particles, it is possible to produce secondary X-ray emissions which if analyzed, will identify the chemical composition of the particle making the emissions.

To detect the secondary emissions emanating from the particles within the separator, a detector 106 is placed within the separator device. Detector 106 receives the X-ray emissions emanating from the particles and converts them into an electronic signal. The signal is passed through a multi-channel analyzer 108 and then through a plurality of single channel analyzers 110 which are capable of producing electric signals corresponding to the percentages of each particle type in the air stream. For example, if the pyrite percentage is high and the sodium ash producing particles are low in percentage, the signals emanating from the single channel analyzers 110 will reflect these percentages. The signals are then directed to power means such as solenoids 112, 114 and 116 which in turn are connected to plates 74, 76 and 78.

Movement of plates 74,76,78 can result in an infinite combination of sizes and shapes for openings 92, 94, 96. For example, movement of all of the plates 74, 76, 78 to the extreme left as viewed in FIG. 4, will leave opening 80 completely exposed. Plates 84, 88 and 78 may be moved to other combinations of positions to produce almost any of an infinite variety of shapes and sizes of openings of the particles exposed to opening 80. The single channel analyzers can be programmed so as to cause solenoids 112–116 to move plates 74–78 to predetermined selected positions in response to various percentage combinations of the impurity particles within the coal. For example, if the coal is very high in pyrite impurities and very low in sodium impurities, the plates can be moved to expose the left end of opening 80 and to close the right end. Similarly, if the pyrites are low in percentage and the sodium and calcite particles are high in percentage, then the left end of opening 80 can be closed by plates 84, 88 and 78. These adjustments permit the device to be selectively tuned to capture the greatest percentage of impurity particles, which at the same time minimizing the amount of coal which is also captured.

Referring to FIG. 7, a modified form of the present invention is shown. FIG. 7 illustrates an axial symmetric arrangement of the separating device. An inlet conduit 112 receives the air stream having the particles therein. An enlarged diameter portion 114 causes the air stream to expand radially outwardly in a fashion similar in nature to the right angle bending of the particles within container 10 as shown in FIG. 1. A collector device 116 is centrally located in the enlarged diameter portion 114 and includes capturing openings 118 for receiving the particles of heavier density. For example, particle P4 is shown in a trajectory which causes it to enter one of capturing openings 118. A conduit 120 is connected to collector device 116 for carrying the particles away to an extractor such as extractor 98 as shown in FIG. 4.

The lighter particles of coal will deflect the greatest amount and will bypass collector device 116 to ultimately pass through outlet opening 122. It is believed that this axial symmetric arrangement of the separator device will produce a more sharply delineated separation of the pyrites from the coal particles than is achieved with the two dimensional device shown in FIG. 1.

The basic principle behind the present invention is the concept of changing the direction of an air stream carrying the particles to be separated, and this concept can be embodied in numerous geometric arrangements. For example, in FIG. 8, an elbow bend 124 is provided at an acute angle with respect to an inlet opening 126. A collector conduit 128 continues on past double bend 124 and is connected to an extractor 98 for receiving the heavy particles. The air stream progresses around the elbow bend 124, and the lighter carbon particles of the coal will continue around the elbow bend with the air stream, whereas, the heavier particles will continue on in a straight line, or an approximate straight line to be captured by extractor 98.

Thus, it can be seen that the device accomplishes at least all of its stated objectives. The device permits the separation of impurities from coal so as to eliminate or at least partially eliminate the need for anti-pollution equipment to take the unburned purities out of the smoke stack emissions. The device also permits the reduction of undesirable products of combustion from coal prior to the burning thereof. This separation also reduces the slag formation in the boiler of the coal burning device. Higher temperature of combustion is also achieved when these particles are removed. The present device uses a minimum of energy to separate the particles. When compared to the energy consumption of most scrubber devices used in conventional steam production systems, the separation device of the present invention is significantly more efficient. The present device may be adjusted in response to variation in percentages of the chemical composition of the particles passing therethrough, and also may be adjusted in response to variations in the velocity of the air stream passing through the separating device.

What is claimed is:

1. Apparatus for separating by density a plurality of particles which are dispersed in a fluid stream, said apparatus comprising:

a housing having a plurality of walls defining a separation chamber, said housing having spaced apart inlet and outlet openings for permitting said fluid stream to enter into said chamber and exit from said chamber respectively;

said outlet opening being in communication with an outlet passageway;

an elongated inlet passageway connected to said inlet opening for introducing said fluid stream into said chamber in a first line of direction of fluid flow;

said outlet opening being located laterally from said first line of direction of fluid flow whereby said fluid stream changes direction as it passes through said chamber and out through said outlet opening;

said housing having a collector wall defining one boundary of said chamber, said collector wall being spaced from said inlet opening and extending transversely to said first line of direction;

said housing having a curved wall defining another boundary of said chamber and extending from said inlet opening to said outlet opening;

a collector movably mounted to said collector wall for movement in a direction transverse to said first line of direction of fluid flow, said collector being adapted to capture and carry away particles which strike said collector;

power means connected to said collector for causing selective movement of said collector to a plurality of positions along a line transverse to said first line of direction of fluid flow; and velocity sensing means within said chamber for sensing the velocity of said fluid stream, control means connected to said sensing means and said power means and being responsive to varying velocities of said fluid stream for causing said power means to selectively move said collector to a plurality of preselected positions each of which corresponds to a different fluid velocity.

2. Apparatus according to claim 1 wherein said inlet passageway is horizontal and said outlet opening is in the same approximate horizontal plane as said inlet passageway whereby the effect of gravity on the separation of particles is negligible.

3. Apparatus according to claim 1 comprising a beam emitter positioned within said chamber for bombarding said particles with beams selected from the group consisting essentially of electron beams, X-rays or Gamma rays, said beams being capable of causing secondary characteristic X-rays to be emitted from said particles, a detector within said chamber for detecting said characteristic X-rays being emitted from said particles, and for converting said X-rays to corresponding electronic signals, said detector being connected to an analyzer circuit for analyzing said signals and producing an output signal reflecting the percentages of various particle types within said fluid stream, said power means being electrically responsive to said analyzer output signal to cause movement of said collector to a plurality of predetermined positions each of which corresponds to a preselected percentage of particle types within said fluid stream.

4. Apparatus according to claim 1 wherein said passageway of said outlet is perpendicular to said passageway of said inlet opening.

5. Apparatus according to claim 1 wherein said passageway of said outlet opening is disposed at an acute angle with respect to said passageway of said inlet opening.

6. Apparatus according to claim 1 wherein said passageway of said outlet opening is disposed at an obtuse angle with respect to said passageway of said inlet opening.

7. Apparatus according to claim 1 wherein said curved boundry wall is in cross section a 90° segment of a circle.

8. Apparatus according to claim 1 wherein said curved boundry wall is in cross section a hyperbola.

9. Apparatus according to claim 1 wherein said outlet opening in cross section is donut shaped having an inner annular wall and an outer annular wall, said inner annular wall surrounding and being spaced radially outwardly from said first directional path of said fluid stream whereby said fluid stream will be forced to divert radially outwardly in order to exit through said outlet, said collection means being positioned radially inwardly from said inner annular wall of said outlet opening.

10. A method for separating a mixture of particles on the basis of density and size, said method comprising, dispersing said particles in a fluid stream moving in a first directional line;

passing said fluid stream into the inlet opening of a housing, through a separating chamber within said housing and out of said housing through an outlet opening located laterally from said first directional line, said housing having a curved wall within said chamber extending between said inlet and outlet openings and a collector wall within said chamber spaced from said inlet opening and extending transversely to said first directional line of fluid movement;

diverting said fluid stream from said first directional line of movement as it enters said inlet opening to a second line of movement as it passes through said chamber and out said outlet opening whereby said particles will separate adjacent the point of fluid diversion into various trajectories each corresponding to a unique value of B in the following formula:

$$B=(18\mu y_o/\rho_p V_o d^2)$$

where the various parameters of B are as follows:

$\mu$ is the absolute viscosity of air, $y_o$ is the distance of said collector wall from said inlet opening, $V_o$ is the fluid velocity, $\rho_p$ is the particle density, and d is the particle diameter, the value of B being above a certain critical value for trajectories extending from said inlet to said outlet free from intersection with said collector wall, and the value of B being below said critical value for trajectories intersecting with said collector wall;

positioning capturing means on said collector wall in the path of said trajectories which intersect with said collector wall;

using said capturing means to capture said particles which travel in the trajectories intersecting with said collector wall;

controlling said parameters of B so that a first group of said particles by virtue of their size and density will produce a value of B greater than said critical value and so that a second group of said particles by virtue of their size and density will produce a value of B less than said critical value whereby said first group will pass outwardly through said outlet opening and said second group will be captured by said capturing means.

11. A method according to claim 10 comprising using a separation chamber bounded by said curved wall, said collector wall, and a third wall extending from said inlet opening to said collector wall and at right angles to said collector wall, said curved wall being a 90° segment of a circle; capturing a substantial number of those particles having a volume and density which gives them a value of B less than 4.1.

12. A method according to claim 10 comprising introducing particles of homogeneous density and varying size into said fluid stream whereby particles of the same size will tend to have approximately the same trajectory and separation is accomplished by collecting particles with separate capturing means placed on said collector wall in the separate paths of various preselected particle trajectories.

13. A method according to claim 12 comprising introducing particles of approximately homogeneous size and varying density into said fluid stream whereby particles of the same density will tend to have approximately the same trajectory and separation is accomplished by collecting particles with separate capturing means placed on said collector wall in the separate paths of various preselected particle trajectories.

14. A method according to claim 10 comprising introducing coal dust of approximately the same particle size into said fluid stream, said coal dust having coal and pyrite particles therein, controlling the parameters of B so as to cause the value of B for said pyrite particles to be below said critical value and to simultaneously cause the value of B for said coal particles to be above said critical value whereby said coal particles will pass through said outlet opening and said pyrite particles will be captured by said capturing means.

15. A method according to claim 14 comprising introducing coal dust into said fluid stream which also has silica and clay particles therein, controlling the parameters of B so as to maintain the value of B less than said critical value for said silica and clay particles; and capturing said silica and clay particles with said capturing means.

16. A method according to claim 10 comprising sensing the velocity of said fluid stream and moving said capturing means in a direction transverse to said first directional line to a plurality of predetermined positions each chosen to correspond to a particular fluid velocity.

17. A method according to claim 10 comprising:

bombarding said particles in said fluid stream with a beam capable of causing each one of said particles to emit a secondary X-ray which is characteristic of the chemical composition of said one particle, said beam being selected from the group consisting essentially of electron beams, X-rays, or Gamma rays, detecting the secondary X-rays being emitted from said particles, analyzing said secondary X-rays to determine the percentages of said particles having given chemical compositions; and moving said capturing means in response to the sensing of changes in percentages of chemical composition of said particles, said movement being transverse to said first directional line of fluid flow so as to move said capturing means into a plurality of positions each of which lie in the trajectory of particles of a desired chemical composition.

* * * * *